US010450707B2

(12) United States Patent
Jesse-Windelband et al.

(10) Patent No.: US 10,450,707 B2
(45) Date of Patent: Oct. 22, 2019

(54) GUTTER

(71) Applicant: ACO Severin Ahlmann GmbH & Co. Kommanditgesellschaft, Büdelsdorf (DE)

(72) Inventors: Bengt Jesse-Windelband, Osterrönfeld (DE); Stephan Meier, Albersdorf (DE)

(73) Assignee: ACO SEVERIN AHLMANN GMBH & CO KG, Budelsdorf (DE)

( * ) Notice: Subject to any disclaimer, the term of this patent is extended or adjusted under 35 U.S.C. 154(b) by 0 days.

(21) Appl. No.: 16/075,737

(22) PCT Filed: Feb. 22, 2017

(86) PCT No.: PCT/EP2017/053996
§ 371 (c)(1),
(2) Date: Nov. 9, 2018

(87) PCT Pub. No.: WO2017/144501
PCT Pub. Date: Aug. 31, 2017

(65) Prior Publication Data

US 2019/0145054 A1 May 16, 2019

(30) Foreign Application Priority Data

Feb. 24, 2016 (DE) ..... 10 2016 103 274

(51) Int. Cl.
*E01C 11/22* (2006.01)

(52) U.S. Cl.
CPC ..... *E01C 11/227* (2013.01); *E01C 2201/20* (2013.01)

(58) Field of Classification Search
CPC ..... E01C 11/227; E01C 2201/20; E03F 3/046
USPC ..... 404/2, 4
See application file for complete search history.

(56) References Cited

U.S. PATENT DOCUMENTS 3,225,545 A 12/1965 Flegel
4,940,359 A * 7/1990 Van Duyn ..... E01C 11/227 404/2
5,213,438 A 5/1993 Barenwald
5,718,537 A 8/1998 Allen

FOREIGN PATENT DOCUMENTS

DE 4128068 A1 3/1992
DE 4240909 A1 9/1993
DE 19520801 C1 10/1996
(Continued)

OTHER PUBLICATIONS

Office Action issued in corresponding Russian Patent Application No. 2018133054; dated Jun. 26, 2019.

*Primary Examiner* — Raymond W Addie
(74) *Attorney, Agent, or Firm* — Pearne & Gordon LLP

(57) ABSTRACT

The invention relates to a gutter element for draining, for example, road surfaces, which can be joined together to form a line of guttering. In order to seal off the connection, an elastic seal (30) is provided in the abutment region. In order to improve the hydraulic properties of the gutter, the cross-sectional profile of the invert (16) of the gutter (10) is substantially V-shaped. To improve sealing, the profile following the seal (30) in cross-section should be formed differently to that of the invert (16) in such a way that it has a constant maximum radius of curvature in the region of the gutter invert.

9 Claims, 3 Drawing Sheets

(56) References Cited

FOREIGN PATENT DOCUMENTS

Figure 1:
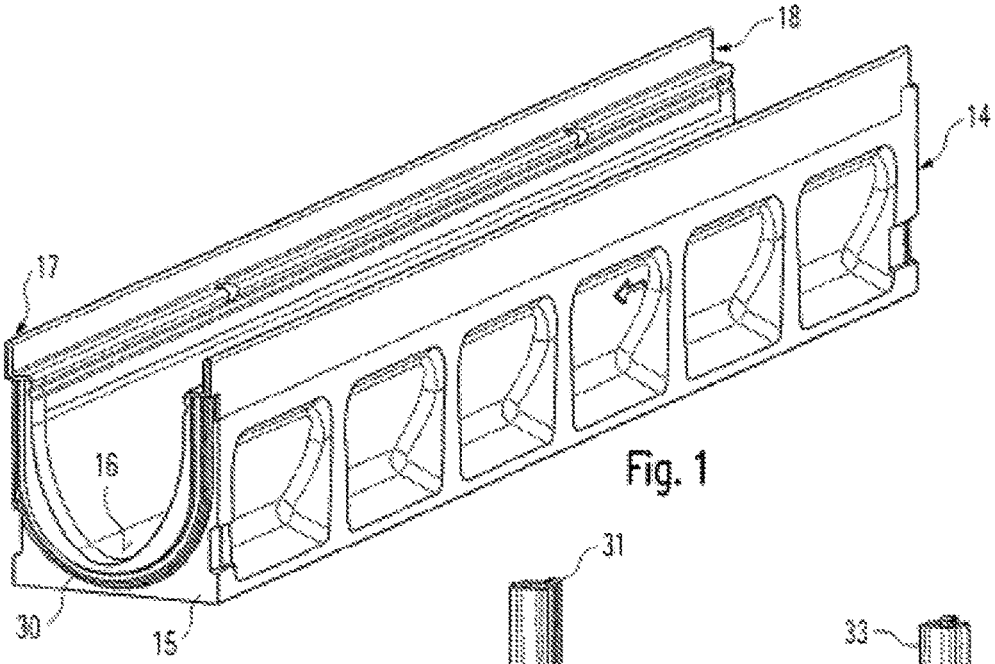

| | | | |
|---|---|---|---|
| DE | 202009017312 | U1 | 4/2010 |
| EP | 0542701 | A1 | 5/1993 |
| JP | 2012087542 | A | 5/2012 |
| RU | 2552264 | C1 | 6/2016 |

* cited by examiner

GUTTER

The invention concerns a gutter for draining, for example a road surface according to the preamble of claim 1.

There is an increasing requirement for such gutters that the assembled line of gutters is fully sealed. This means that the joints between the individual gutter elements must be leak-proof. As shown, for example, in DE 41 28 068 A1 or DE 20 2009 017 312 U1, this is achieved in that seals are inserted or cast in between adjoining gutter elements. Such seals require a tight abutment of the end faces of adjoining gutters.

If seals are inserted, the retaining grooves for the seals in known gutters match the cross-sectional profile of the inner shape of the gutter. This is not difficult with the above-described gutters since they are provided with relatively large curvature radii that match the inner space profiles. However, in the instance that the cross-sectional profile is more V-shaped than semicircular, which is often the case when improving the hydraulic properties, the seals are curved too tightly, which leads to leakage and breakage during prolonged use.

It is the object of the invention to provide a gutter of the kind described at the outset in such a way so as to ensure increased tightness as well as improved ease of installation and durability.

This object is met by a gutter according to claim 1.

This object, in particular a gutter for draining of, for example, a road surface, comprising a first and a second end, wherein the first end of a first gutter may be connected to the second end of a second gutter in longitudinal axis of the gutters, and an elastic seal is provided on a retaining surface of the gutter to seal the joint, wherein an invert of the gutter has a cross-sectional profile that deviates from a semicircular shape, is met in that the retaining surface is provided with a cross-sectional profile in the direction of the longitudinal axis, which deviates from that of the invert in that a maximum curvature radius is provided at every point of the retaining surface and therefore also the seal.

A significant point of the invention lies therefore in the fact that, contrary to common practice where the seal follows the contour of the edge to be sealed, a very specific shape is chosen, which improves the durability and sealing capacity of the overall installation.

The cross-sectional profile of the retaining surface, and thus the curved shape of the seal, is essentially semicircular. An even curved shape of this kind causes minimal tensile loads during bending.

The retaining surface is preferably provided with a retaining slot for retaining an attachment flank of the seal, wherein the retaining slot is preferably disposed on the inner side of the retaining surface. This provides a simple way of ensuring that the seal is securely located.

A sealing shoulder for engaging with the seal of a further gutter is disposed preferably at that end of the gutter that is located opposite to the retaining surface. The sealing shoulder and the seal are in this instance in a sealing engagement in a direction perpendicular to the longitudinal axis of the gutter with the result that an abutment of the end faces accurate to the millimetre is not necessary according to the present invention but is required in the prior art.

The gutter is preferably provided with an abutment surface for the seal acting in a direction perpendicular to the longitudinal axis of the gutter. Said abutment surface may be formed on the sealing shoulder.

The sealing shoulder and the seal are preferably formed deep in the direction of the longitudinal axis of the gutter in such a way that a tilting of two adjoining gutters is possible whilst the sealing shoulder is engaged with the seal. This makes it possible to install gutters in (slight) curves or follow surface contours in other ways.

The sealing shoulder is preferably provided with said abutment surface on a surface that faces inwards, which engages with the seal and forms a tight connection.

Figure 2:
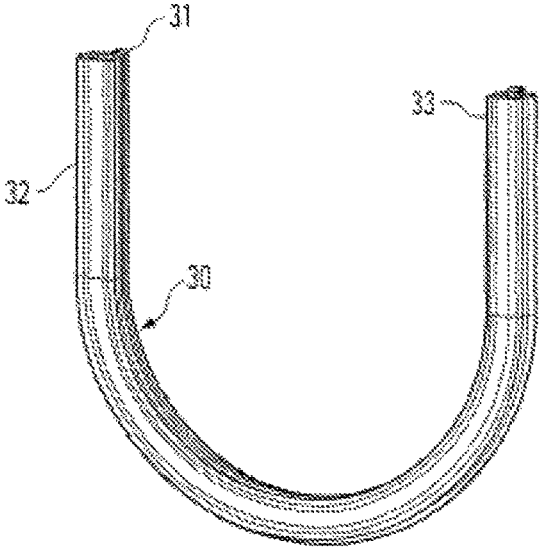
Figure 3:
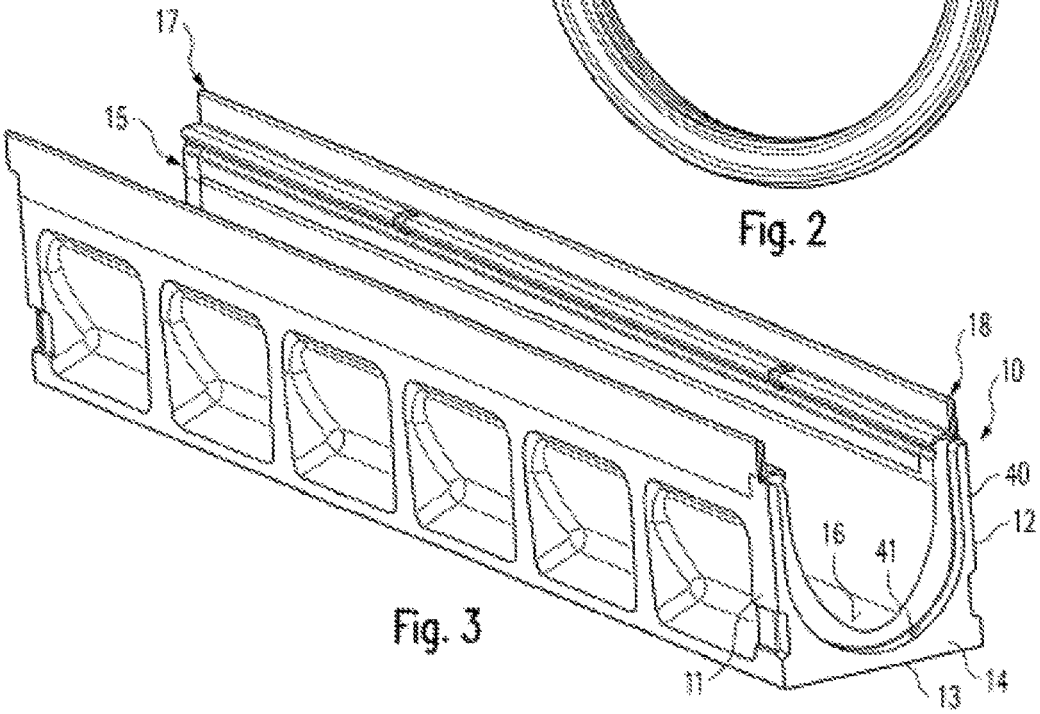
Figure 4:
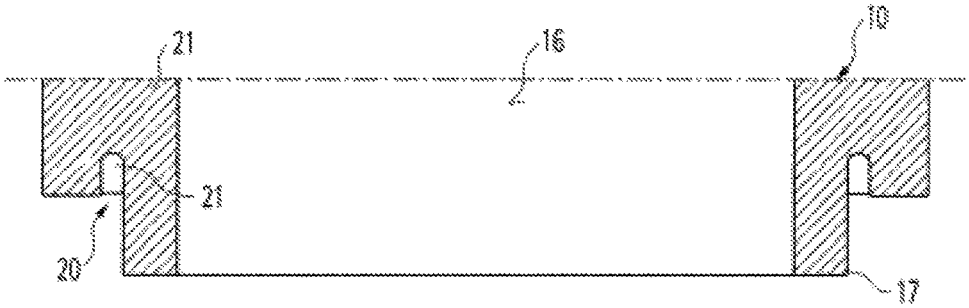
Figure 5:
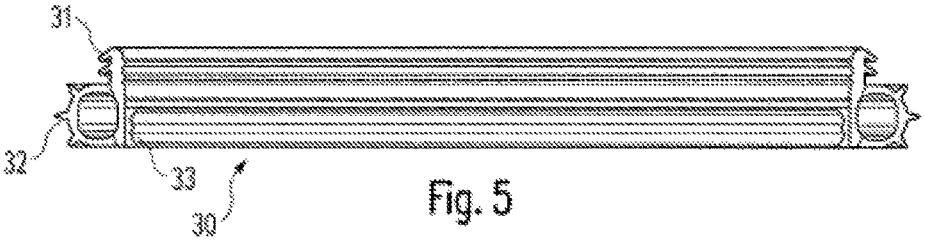
Figure 6:
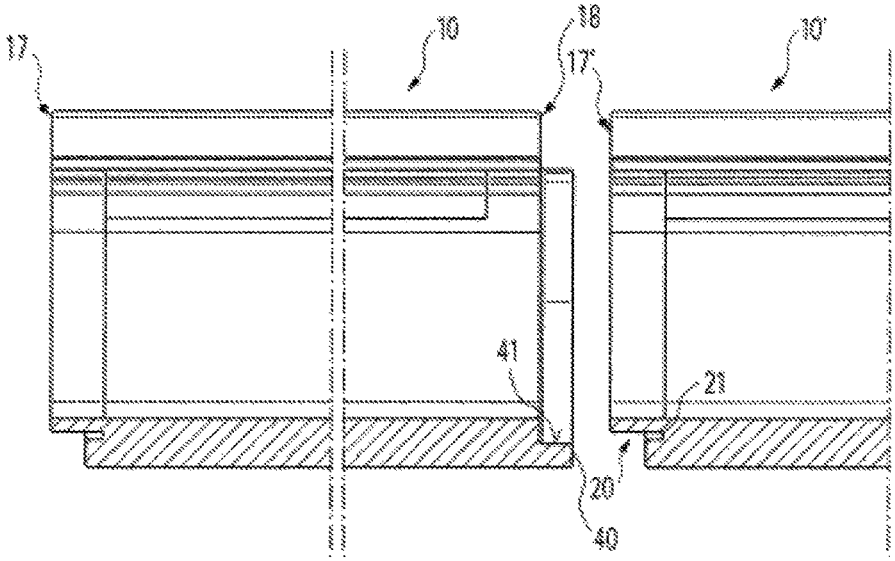
Figure 7:
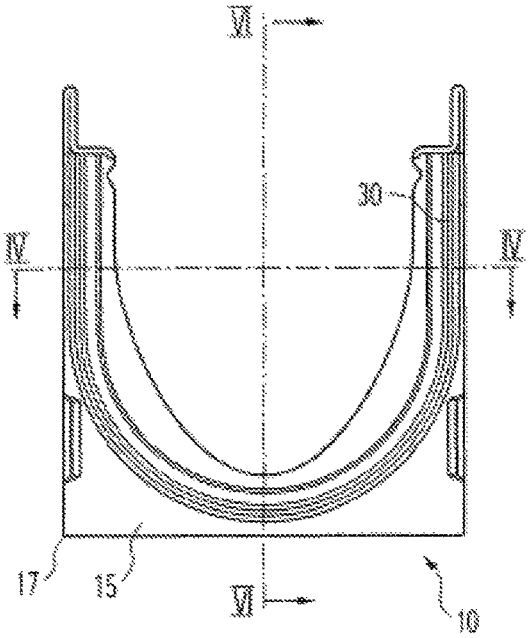
Figure 8:
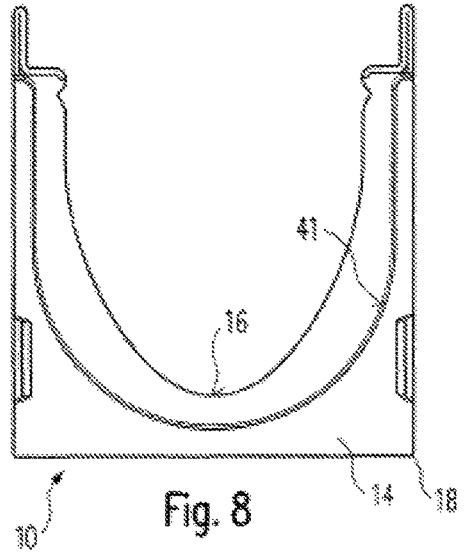

Preferred embodiments of the invention will now be explained in greater detail by way of the drawings. Shown are in:

FIG. 1 a perspective view of a gutter showing an end face with sealing shoulder disposed thereon;

FIG. 2 the sealing shoulder of FIG. 1 shown enlarged;

FIG. 3 the arrangement according to FIG. 1 but rotated so that the second end face can be seen;

FIG. 4 a cross-section along line IV-IV in FIG. 7 in which a sealing shoulder may be provided;

FIG. 5 a sealing shoulder of the kind that may be inserted in FIG. 4;

FIG. 6 a cross-section through two adjoining gutters along the line VI-VI of FIG. 7;

FIG. 7 a front view of a gutter according to FIG. 1;

FIG. 8 a rear view of a gutter according to FIG. 1, and

Figure 9:
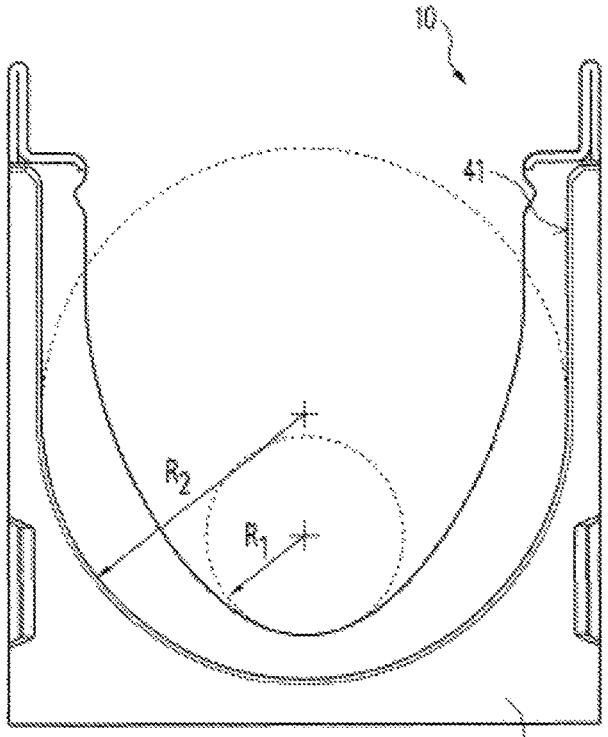

FIG. 9 a depiction according to FIG. 8 to help explain the different profiles of gutter invert and seal.

The following description uses the same reference numbers for the same parts or parts that have the same function.

The perspective representation of the exemplary embodiment according to FIGS. 1-3 shows that the gutter 10 is provided with side walls 11, 12 and a bottom 13 as well as end walls 14, 15. The inner space or the invert of the gutter 10 respectively is designated with the reference number 16. A seal 30 is attached to the gutter 10 at a first end 17 via an attachment flank 31, which rests in a corresponding slot of gutter 10 described in more detail later. The seal 30 is provided with an outer sealing lip 32 and an inner sealing lip 33. It is also possible to forgo the sealing lip 32 so that the main body of the seal comes into contact with the abutment surface 41.

A sealing shoulder 40, which has an abutment surface 41 facing to the inside, is provided at a second end 18. If two gutters of the kind described here are joined in such a way that the first end 17 of a first gutter 10 is connected to a second end 18 of a second gutter, the outer sealing lip 32 is joined tightly to the abutment surface 41 of the sealing shoulder 40 as described in more detail below by way of FIGS. 4-6.

FIG. 4 shows a first end 17 of a gutter 10 in horizontal section. Here it is apparent that the end 17 is provided with a protruding retaining surface 20 as well as a slot 21 that extends the retaining surface in longitudinal direction of the gutter 10. The seal 30 shown in FIG. 5 is provided with an attachment flank 31 with interlocking lips, which is inserted into slot 21 and locked in. The inner sealing lip 33 presses hard against the retaining surface 20 whilst the outer sealing lip 32 protrudes to the outside. If two gutters 10, 10' are now joined, a first end 17' of the gutter 10' forms a sealed connection with the second end 18 of the gutter 10, as shown in FIG. 6. Due to the fact that the sealing of the joint does not depend on the end faces 14 and 15 of subsequent gutters being pressed together but that the sealing action is, as it were, in radial direction, that is, in a direction perpendicular to the longitudinal axis of the gutter, the subsequent gutters do not necessarily have to be tightly pressed together. There can be some play which allows the subsequent gutters to be tilted with respect to each other without diminishing the sealing action.

The FIGS. 7-9 depict next to each other the end faces 14, 15 or the ends 17, 18 respectively of a gutter to indicate that the profile of the invert 16 of the gutter 10 deviates from the profile of the seal 30 or the sealing shoulder 40 respectively. Whilst the profile of the invert 16 of the gutter 10 is approximately V-shaped with a very small curvature radius $R_1$, the profile of the seal 30 or the sealing shoulder 40 respectively has in its curved section a uniform, much larger curvature radius $R_2$ that follows a semicircle. This has the effect that on the one hand even at low water quantities a relatively high flow rate is achieved in gutter 10, which improves the flushing out of dirt deposits, and on the other hand the seal 30 is routed to cause the least amount of curvature strain or has the largest curvature radius that is possible considering the overall size of the gutter 10. This causes on the one hand a less than usual strain on the seal, but on the other hand ensures good hydraulic performance.

It should be noted here that the seal 30 and the sealing shoulder 40 may also be arranged in reverse, that is, the seal 30 may point inwards and the sealing shoulder 40 with its abutment surface 41 outwards. Moreover, a different kind of attachment of the seal 30 to the retaining surface 20 is possible.

REFERENCE NUMBERS

10, 10' Gutter
11 Side wall
12 Side wall
13 Bottom
14 End wall
15 End wall
16 Invert
17 First end
18 Second end
20 Retaining surface
21 Slot
30 Seal
31 Attachment flank
32 Outer sealing lip
33 Inner sealing lip
40 Sealing shoulder
41 Abutment surface
$R_1$ Curvature radius of invert
$R_2$ Curvature radius of seal

The invention claimed is:

1. A gutter for draining a road surface comprising:

a first gutter (10) comprising a first end (17) and a second end (18), the first end (17) of the first gutter (10) positioned on a retaining surface (20), an invert (16) of the first gutter (10) has a non-semicircular cross-sectional profile, the retaining surface (20) has a cross-sectional profile in the direction of the longitudinal axis that deviates from the non-semicircular cross-sectional profile, the invert (16), and the retaining surface (20) comprises a retaining slot (21) for retaining an attachment flank (31) of a seal (30), wherein the retaining slot (21) is disposed on an inner side of the retaining surface (20) and extends in the direction of the longitudinal axis of the first gutter (10).

2. The gutter of claim 1, wherein the cross-sectional profile of the retaining surface (20) is semicircular.

3. The gutter of claim 1, wherein a sealing shoulder (40) for engagement with the seal (30) of a second gutter (10'), the sealing shoulder is positioned at an end (18) of the second gutter that lies opposite the retaining surface (20) of the first gutter (10).

4. The gutter of claim 3, wherein the sealing shoulder (40) and the seal (30) extend in a direction perpendicular to the longitudinal axis of the first gutter in a sealing engagement.

5. The gutter of claim 4, wherein the first gutter (10) comprises an abutment surface (41) for pressing the seal (30) against the first gutter (10) in a direction perpendicular to the longitudinal axis of the first gutter.

6. The gutter of claim 5, wherein the shape of the sealing shoulder (40) and the seal (30) extends in the direction of the longitudinal axis of the first gutter to form a tilt between the adjoining first and second gutters (10, 10'), wherein the engagement of the sealing shoulder (40) with the seal (30) is retained.

7. The gutter of claim 3, wherein the sealing shoulder (40) comprises an abutment surface (41) located on an inward-facing surface of the first gutter.

8. A gutter for draining a road surface comprising:

a first gutter (10) comprising a first end (17) and a second end (18), the first end (17) of the first gutter (10) is positioned on a retaining surface (20), an invert (16) of the first gutter (10) has a non-semicircular cross-sectional profile and the retaining surface (20) has a cross-sectional profile that deviates from the non-semicircular cross-sectional profile the invert (16), and a sealing shoulder (40) for engagement with a seal (30) of a second gutter (10'), the sealing shoulder is positioned at an end (18) of the second gutter that lies opposite the retaining surface (20) of the first gutter (10).

9. The gutter of claim 8, wherein the retaining surface (20) comprises a retaining slot (21) for retaining an attachment flank (31) of a seal (30), the retaining slot (21) is disposed on an inner side of the retaining surface (20) and extends in the direction of the longitudinal axis of the first gutter (10).

* * * * *